US007396097B2

(12) United States Patent
Yamazaki et al.

(10) Patent No.: US 7,396,097 B2
(45) Date of Patent: Jul. 8, 2008

(54) PRINTING CONTROL METHOD, PRINTING CONTROL APPARATUS, MEDIUM ON WHICH PRINTING CONTROL PROGRAM IS RECORDED

(75) Inventors: Satoshi Yamazaki, Nagano (JP); Koichi Yoshizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 10/752,304

(22) Filed: Jan. 5, 2004

(65) Prior Publication Data

US 2004/0226468 A1 Nov. 18, 2004

(30) Foreign Application Priority Data

Jan. 8, 2003 (JP) ..... 2003-2194

(51) Int. Cl.
*B41J 2/025* (2006.01)

(52) U.S. Cl. ..... 347/15; 347/19; 358/1.9; 358/518; 358/517

(58) Field of Classification Search ..... 347/15, 347/100, 6, 19, 1.9, 518, 517
See application file for complete search history.

(56) References Cited

U.S. PATENT DOCUMENTS 5,497,180 A * 3/1996 Kawakami et al. ..... 347/131
5,917,994 A * 6/1999 Perumal et al. ..... 358/1.9
5,988,791 A 11/1999 Miyashita et al.
6,196,663 B1 * 3/2001 Wetchler et al. ..... 347/43
6,325,487 B1 * 12/2001 Mantell ..... 347/41
6,378,983 B1 * 4/2002 Ito et al. ..... 347/43
6,474,799 B1 * 11/2002 Shimada et al. ..... 347/86
6,592,212 B1 * 7/2003 Kakutani ..... 347/86
2002/0085057 A1 * 7/2002 Endo ..... 347/19

(Continued)

FOREIGN PATENT DOCUMENTS

JP 08-085219 4/1996

(Continued)

OTHER PUBLICATIONS

Visual Expert Human Factors, SBFAQ Part 1: Basic Terms and Definitions, 2004, Visual Expert, http://www.visualexpert.com.FAQ/Part1/cfaqpart1.html.*

(Continued)

*Primary Examiner*—Manish S. Shah
*Assistant Examiner*—Laura E Martin
(74) *Attorney, Agent, or Firm*—Martine Penilla & Gencarella, LLP

(57) ABSTRACT

The conventional print-controlling apparatus performs printing with CMY inks and additional inks having a lower lightness than CMY inks, which are mixed in a specific ratio when ejected from the print head, so that colors in the entire range from low to high lightness are expressed. Unfortunately, chromatic color inks differing in hue from CMY inks have a low lightness or a high density, and this leads to poor granularity in the region of high lightness. This disadvantage is eliminated if color conversion is accomplished by using the granularity improvement LUT 15*c* that limits the deposition of RV inks. In this way it is possible to limit the ejection of RV inks in the region of high lightness and to improve the ink granularity in the region of high lightness.

9 Claims, 15 Drawing Sheets

U.S. PATENT DOCUMENTS

| | | | | |
|---|---|---|---|---|
| 2002/0097294 | A1* | 7/2002 | Shibata et al. | 347/43 |
| 2002/0097412 | A1* | 7/2002 | Shibata et al. | 358/1.9 |
| 2003/0151756 | A1 | 8/2003 | Yamazaki et al. | |

FOREIGN PATENT DOCUMENTS

| | | |
|---|---|---|
| JP | 2000-343731 | 12/2000 |
| JP | 2002-211015 | 7/2002 |
| JP | 2003-205631 | 7/2003 |

OTHER PUBLICATIONS

Abstract of Japanese Patent Publication No. JP 08-085219, Pub. Date: Apr. 2, 1996, Patent Abstracts of Japan.
Abstract of Japanese Patent Publication No. JP 2000-343731, Pub. Date: Dec. 12, 2000, Patent Abstracts of Japan.
Abstract of Japanese Patent Publication No. JP-2002-211015, Pub. Date: Jul. 31, 2002, Patent Abstracts of Japan.

* cited by examiner

FIG. 4

| sR | G | B | C | M | Y | K | R | V |
|---|---|---|---|---|---|---|---|---|
| 0 | 0 | 0 | 3 | 0 | 0 | 252 | 0 | 3 |
| | ⋮ | | | | ⋮ | | | |
| 128 | 128 | 128 | 152 | 0 | 72 | 0 | 160 | 0 |
| | ⋮ | | | | ⋮ | | | |
| 255 | 255 | 240 | 1 | 0 | 3 | 0 | 1 | 0 |
| 255 | 255 | 255 | 0 | 0 | 0 | 0 | 0 | 0 |

PRINTING CONTROL METHOD, PRINTING CONTROL APPARATUS, MEDIUM ON WHICH PRINTING CONTROL PROGRAM IS RECORDED

BACKGROUND OF THE INVENTION

1. Field of the Invention

The present invention relates to a print-controlling method, a print-controlling apparatus, a medium recording said print-controlling program, an apparatus for preparing a color conversion table, a method for preparing said color conversion table, and a medium recording a program for preparing said color conversion table, which are applicable to printing in which the print head ejects at least three chromatic color inks and additional chromatic color inks having a lower lightness than said three chromatic color inks.

2. Description of the Prior Art

There has been known a print-controlling apparatus designed for printing with CMY inks and additional inks (such as red and violet inks) differing in hue from CMY inks, which are ejected from the print head. For expression of each color's tone, outputs are made separately with CMY inks and chromatic color inks differing in hue from CMY inks. The chromatic color inks usually have a lower lightness than CMY inks. The background art of the present invention is disclosed in Japanese Patent Application No. 2002-4816.

The conventional print-controlling apparatus mentioned above performs printing with CMY inks and additional inks having a lower lightness than CMY inks, which are mixed in a specific ratio when ejected from the print head, so that colors in the entire range from low to high lightness are expressed. Unfortunately, chromatic color inks differing in hue from CMY inks have a low lightness or a high density, and this leads to poor granularity in the region of high lightness.

SUMMARY OF THE INVENTION

The present invention was completed in order to address the problem mentioned above. It is an object of the present invention to provide a print-controlling method, a print-controlling apparatus, a medium recording a print-controlling program, an apparatus for preparing a color conversion table, a method for preparing said color conversion table, and a medium recording a program for preparing said color conversion table, which are applicable to printing in which the print head ejects chromatic color inks having a low lightness in controlled amounts for improvement in granularity.

According to the present invention, the above-mentioned problem is solved at least partly by controlling the amount of chromatic color inks having a lower lightness to be ejected in combination with at least three chromatic color inks at the time of printing. Thus, the object of the present invention is achieved by a print-controlling method, a print-controlling apparatus to realize said control, and a medium recording a print-controlling program to realize said control.

The print-controlling method comprises a step of prescribing the amount of ink ejection, a step of detecting a condition, and a step of replacing the amount of ink ejection. The first step prescribes the amounts of at least three chromatic color inks and additional chromatic color inks to be ejected from the print head. The second step detects an appropriate condition to limit the amount of additional chromatic color inks to be ejected. When the condition is detected, the third step replaces the amount of additional chromatic color inks to be ejected (which is prescribed by the first step) by the amount of at least three chromatic color inks to be ejected. Replacing the amount of chromatic color inks having a lower lightness by the amount of chromatic inks having a higher lightness leads to improvement in granularity.

The second step detects the limiting condition when the amount of additional chromatic color inks is lower than the first threshold value. In this way the ejection of additional chromatic color inks is limited according to the amount of additional chromatic color inks ejected. The second step calculates the total amount of at least three chromatic color inks and additional chromatic color inks ejected and detects the limiting condition if the amount of additional chromatic color inks is lower than the first threshold value and the total amount of ejected inks is lower than the second threshold value. In this way the ejection of additional chromatic color inks is limited according to the amount of additional chromatic color inks ejected and the total amount of all inks ejected. The second step calculates the amount of at least three chromatic color inks and additional chromatic color inks ejected and detects the limiting condition if the calculated total amount of all inks is lower than the first threshold value. In this way the ejection of additional chromatic color inks is limited according to the total amount of chromatic color inks ejected.

The second step detects the limiting condition if the calculated total amount of all inks ejected is lower than the first threshold value and lower than the third threshold value. In this way the ejection of additional chromatic color inks is limited according to the total amount of all inks ejected. According to a preferred embodiment, the calculation of the total amount of all inks is accomplished by weighting parameters for each of at least three chromatic color inks and additional chromatic color inks. In this way the degree of influence of individual chromatic color inks is reflected in the total amount of all inks ejected.

According to a preferred embodiment, the second step calculates the lightness which is represented on the basis of the amount of at least three chromatic color inks and additional chromatic color inks ejected, and then detects the limiting condition when the calculated lightness is higher than the prescribed one. In this way the ejection of additional chromatic color inks can be limited according to lightness. In the case where there exist a plurality of additional chromatic color inks differing in lightness, they are replaced in the third step sequentially by at least three chromatic color inks in the order of lightness (from low to high). Limiting preferentially the ejection of chromatic color inks having a lower lightness improves granularity because they affect granularity more strongly.

Needless to say, the above-mentioned print-controlling method is patentable also as the apparatus to practice the method and the print-controlling apparatus. Also, in the case where the print-controlling apparatus is realized by means of computer, the medium recording the print-controlling program that realizes the above-mentioned functions by means of computer is also patentable as a matter of course. Moreover, in the viewpoint of controlling the amount of ink ejection, the present invention is valid as means of preparing the color conversion table that prescribes the amount of ink ejection. Therefore, needless to say, the present invention covers the apparatus for preparing the color conversion table to realize the technical idea of the present invention, the method for preparing the color conversion table, and the medium recording the program for preparing the color conversion table.

BRIEF DESCRIPTION OF THE DRAWINGS

FIG. 4 is a diagram showing one example of the LUT.

DESCRIPTION OF THE PREFERRED EMBODIMENTS

The embodiment of the present invention will be described below in the following order.

(1) Construction of the printing system:

(2) Construction of the normal LUT:

(3) Procedure for preparing the normal LUT:

(4) Procedure for preparing the granularity improvement LUT:

(5) Content of printing procedure:

(6) Other procedures for preparing the granularity improvement LUT:

(7) Other procedures for preparing the granularity improvement LUT:

(8) Summary:

(1) Construction of the Printing System

Figure 1:
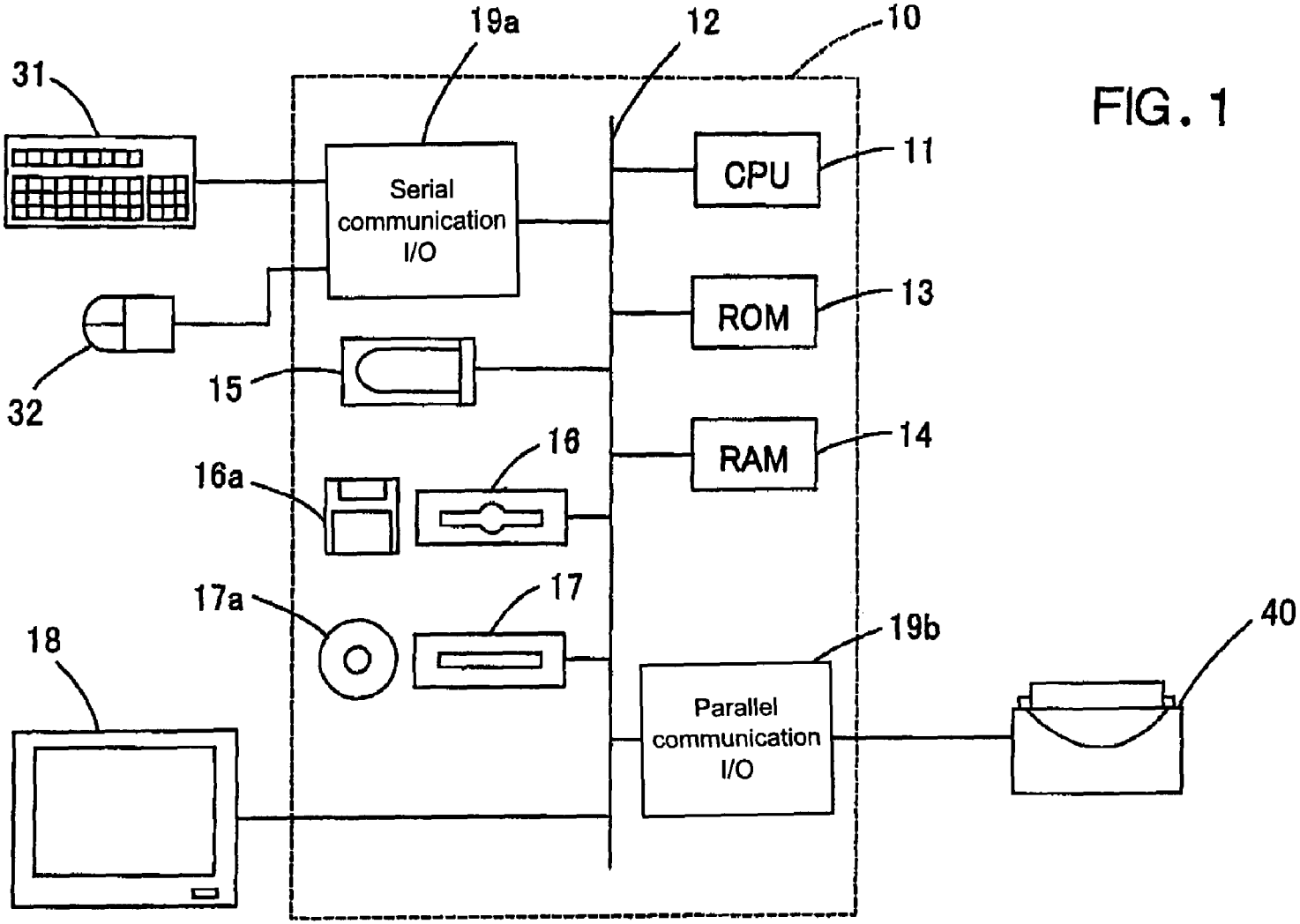
FIG. 1 is a diagram showing the construction of the printing system.
Figure 2:
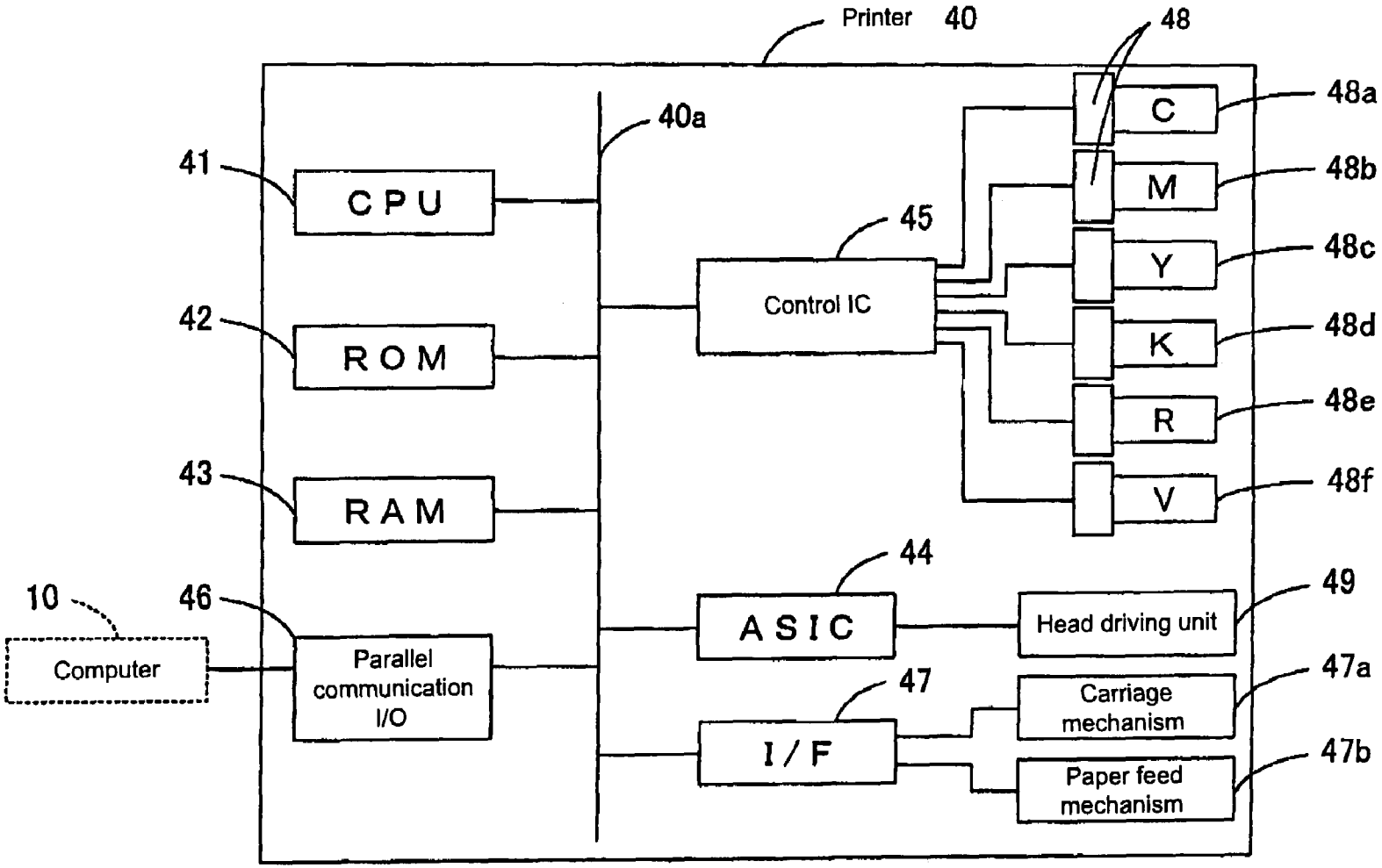
FIG. 2 is a schematic diagram showing the construction of the hardware of the printer.
Figure 3:
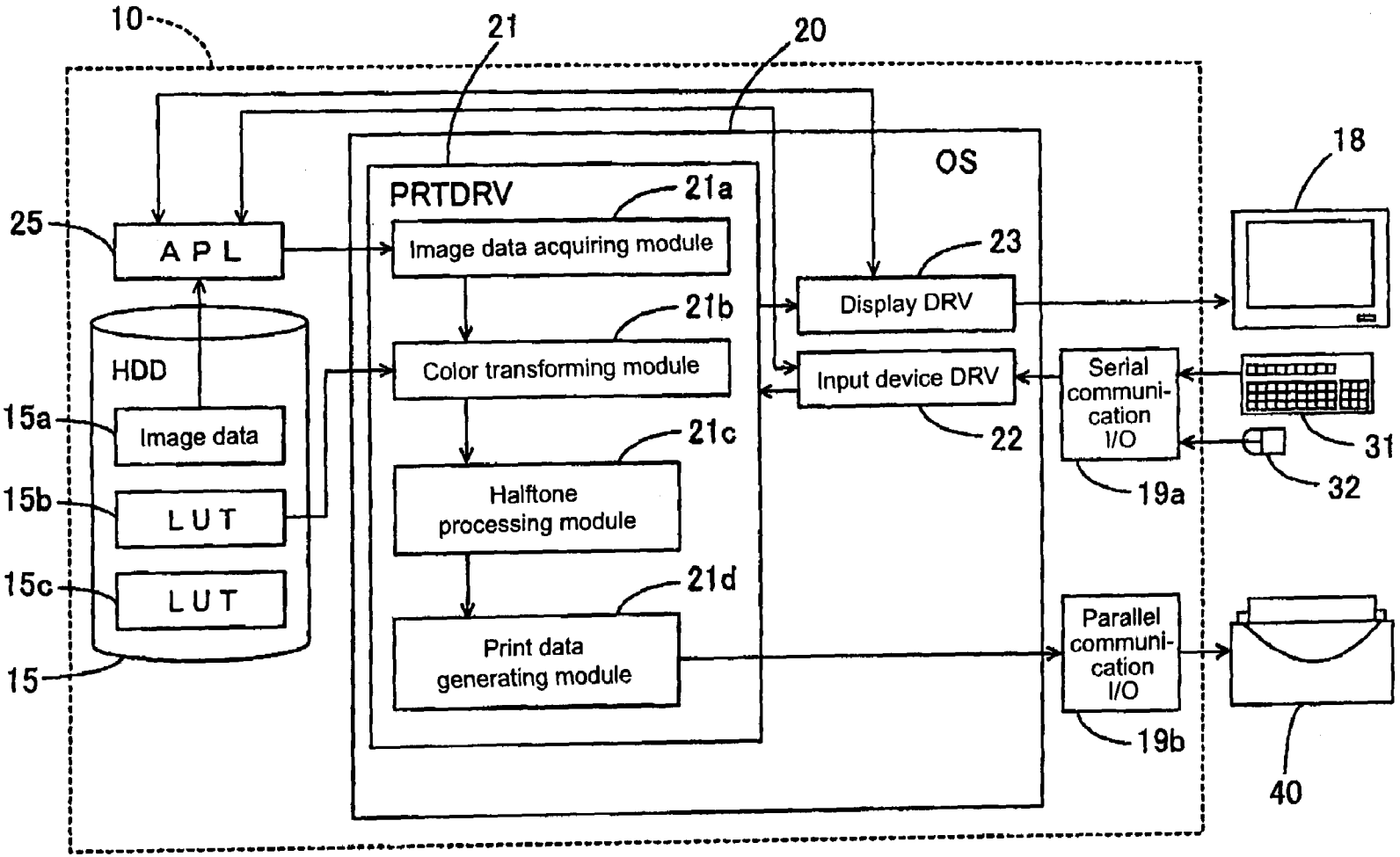
FIG. 3 is a schematic diagram showing the construction of the main control system of the print-controlling apparatus.

FIG. 1 schematically shows the construction of the hardware of the printing system that employs the print-controlling apparatus according to the present invention. FIG. 2 schematically shows the construction of the hardware of the printer. FIG. 3 schematically shows the construction of the main control system of the print-controlling apparatus realized by the computer. In these figures, the computer 10 has the CPU 11 which constitutes the nucleus of computation process. This CPU is capable of accessing the ROM 13 (storing BIOS etc.) and RAM 14 through the system bus 12. The system bus 12 is connected to the hard disc drive (HDD) 15, flexible disc drive 16, and CD-ROM drive 17 as external storage devices, so that the OS 20 and application programs (APL) 25 stored in the HDD 15 are transferred to the RAM 14. The CPU 11 accesses the ROM 13 and RAM 14 from time to time and executes the specific functions of the OS 20 and APL 25. In other words, it carries out various processes while using the RAM 14 as a temporary work area.

In addition, the computer 10 is connected to various input devices (such as keyboard 31 and mouse 32) through the serial communication I/O 19*a* and also to the display 18 through a video board (not shown). Moreover, it can be connected to the color printer 40 through the parallel communication I/O 19*b*. Incidentally, it is explained with reference to a simplified structure, but it may have any construction which is commonly used for personal computers. Needless to say, the computer 10 is not limited to a personal computer. The computer used in this embodiment is a so-called desk-top computer; but it may be of note-book type or mobile type. The connecting interface for the computer 10 and the color printer 40 is not restricted to the one mentioned above; it may be serial interface, SCSI, USB, etc. and it includes any interface that will be developed in the future.

In this embodiment, the programs (such as OS 20 and APL 25) are stored in the HDD 15. However, the recording medium is not restricted to them. For example, it may include the flexible disc 16*a* and CD-ROM 17*a*. The programs stored in these recording media are read into the computer 10 and installed in the HDD 15 through the flexible disc drive 16 and CD-ROM drive 17. Then, they are read into the RAM 14 through the HDD 15 so that they control the computer. The recording media may also includes a magneto-optical disc. It is also possible to use a non-volatile memory (such as flash card) as the semiconductor device. In the case of downloading from an external server through a modem and communication line, the communication line functions as the transmission medium for the present invention.

On the other hand, as shown in FIG. 2, the color printer 40 has therein the bus 40*a* which is connected to the CPU 41, ROM 42, RAM 43, ASIC 44, control IC 45, parallel communication I/O 46, and interface (I/F) 47 for transmission of image data and drive signals. And, the CPU 41 controls various parts according to the prescribed control programs written in the ROM 42, while using the RAM 43 as a work area. The ASIC 44 is a customized IC to drive a print head (not shown). It carries out processing to drive the pint head while sending and receiving prescribed signals to and from the CPU 41. It also sends the head driving unit 49 the data for voltage application.

The head driving unit 49 is a circuit consisting of a special IC and driving transistors. It generates a pattern of voltage to be applied to the piezoelectric element (installed in the print head) according to the data for voltage application which has been entered from the ASIC 44. The print head has the cartridge holder 48 to hold the ink cartridges 48*a* to 48*f* which are filled with six pigment-based inks and supplied with inks through tubes connected thereto. It ejects inks as the piezoelectric element is driven in the ink chamber communicating with the nozzle through a tube. Incidentally, the print head in this embodiment employs not only the general-purpose C (cyan), M (magenta), Y (yellow), and K (black) inks but also R (red) and V (violet) inks. The inks used in this embodiment may be either pigment-based ones or dye-based ones. In this embodiment, R and V inks are used in addition to the CMYK inks; however, they may be replaced by any other inks (such as Green, Blue, and Orange inks) which are different in hue from CMYK inks and are lower in lightness than CMYK inks.

Incidentally, the R and V inks are chromatic color inks having a lower lightness than the chromatic colors of the CMY inks. They approximately flatten the change in light reflectance in the region of visible wavelength of the achromatic colors which they generate when combined with the CMY inks. The print head has the ink ejecting surface on which six nozzle trains to eject six color inks respectively are arranged in the primary scanning direction of the print head.

Each nozzle train consists of a plurality (say, 48) of nozzles which are arranged at certain intervals in the secondary scanning direction. Also, the cartridge holder 48 has an ink supply needle. The ink supply needle forms an ink supply passage when it comes into contact with the ink supply port (not shown) on the ink cartridges 48*a* to 48*f*. This ink supply passage permits the CMYKRV inks to be supplied to the print head through the ink tubes in the ink cartridges 48*a* to 48*f*.

The control IC 45 is intended to control the cartridge memory or nonvolatile memory (not shown) mounted on each of the ink cartridges 48*a* to 48*f*. The control IC 45 is electrically connected to the cartridge memory as soon as the ink cartridges 48*a* to 48*f* are mounted on the cartridge holder 48. Then the control IC 45 sends and receives signals to and from the CPU 41, thereby reading information about the color and residual quantity of inks recorded in the cartridge memory and updating the information about the residual quantity of inks.

The parallel communication I/O 46 is connected to the parallel communication I/O 19*b* of the computer 10. It is through this parallel communication I/O 46 that the color printer 40 receives data and print job from the computer 10, said data specifying the dot density to be formed with CMYKRV inks and said print job being written in page description language. Upon reception of various requests from the computer 10, the CPU 41 acquires information about the color and mounting of inks from the control IC 45 and sends it to the computer 10 through the parallel communication I/O 46.

The I/F 47 is connected to the carriage mechanism 47*a* and the paper feed mechanism 47*b*. This paper feed mechanism 47*b* is composed of a paper feed motor and a paper feed roll (which are not shown), so that it feeds printing paper (and other printing/recording media) and carries out secondary scanning. The carriage mechanism 47*a* is provided with a carriage (not shown) to support the print head and also with a carriage motor (not shown) to run the carriage by means of a timing belt. Therefore, it permits the print head to carry out primary scanning. The print head having a plurality of nozzles arranged in the secondary scanning direction causes each nozzle to eject ink drops for individual dot units. This ink ejection is accomplished by the piezoelectric elements which are driven by the signals which the head driving unit 49 produces according to the head data consisting of bit strings.

The color printer 40 performs printing under control by the printer driver which is installed in the computer 10 and stored in the HDD 15. The computer 10 used in the embodiment shown in FIG. 3 is provided with the printer driver (PRTDRV) 21, the input device driver (DRV) 22, the display driver (DRV) 23, and the OS 20. The display DRV 23 controls the display of image data on the display 18. The input device DRV 22 receives code signals for input operation from the keyboard 31 and the mouse 32 through the serial communication I/O 19*a*.

The APL 25 used in this embodiment is an application program for the retouching of color images. The user (one who uses the program) runs the APL 25 to operate the input devices and print color images on the color printer 40. In other words, the APL 25 reads the image data 15*a* from the HDD 15 into the RAM 14 according to the user's instruction, and it also displays the image on the display 18 according to the image data 15*a* by means of the display DRV 23. In response to the image displayed on the display 18, the user operates the input devices. The user's operation is acquired and interpreted by means of the input device DRV 22. According to the user's operation, the APL 25 issues print instructions and performs retouching and other processes.

The print instruction from the APL 25 drives the PRTDRV 21. Then, the PRTDRV 21 sends data to the display DRV 23, thereby causing the display 18 to display UI (not shown) for input of information necessary for printing. The user watches the UI displayed on the display 18 and sets up parameters, such as the number of pages and copies. These parameters are received by the PRTDRV 21 through the input device DRV 22. Upon receipt of the parameters, the PRTDRV 21 references the normal LUT 15*b* or the granularity improvement LUT 15*c* stored in the HDD 15. Then, the PRTDRV 21 converts the image data 15*a* (with colors specified in terms of sRGB) into color data in terms of CMYKRV, thereby producing print data. The print data is sent to the color printer 40 which executes printing. The normal LUT 15*b* denotes an LUT which is used for color conversion from image data of sRGB into color data of CMYKRV in the usual way.

On the other hand, RV inks have a lower lightness compared with CMY inks, as mentioned above. The advantage of using RV inks in combination with CMY inks is that the resulting CMYRV inks yield an approximately achromatic color whose spectral reflectance is almost flat in the region of visible wavelength, as mentioned above. In other words, they reduce the color inconstancy in approximately achromatic colors. However, being low in lightness, RV inks make ink grains visible in the area where the amount of ink deposition is small, which makes the printed image poor in granularity. Therefore, this embodiment eliminates such a disadvantage by using the granularity improvement LUT 15*c* that limits the deposition of RV inks in the region of high lightness, thereby converting the image data of sRGB into the color data of CMYKRV. Limiting the deposition of RV inks in this way improves the granularity of printed image in the region of high lightness where the amount of ink deposition is small.

(2) Construction of the Normal LUT

FIG. 4 shows one example of the construction of the normal LUT 15*b*. The normal LUT 15*b* is constructed such that each of sRGB data and CMYKRV data has values from 0 to 255 for expression of 256 tones (with 8 bits). For sRGB data, each color component of RGB has its tone value range divided into 16 sections for reference points, so that all the combinations of tone values "0, 16, 32, . . . 255" for each color of RGB are established. It follows, therefore, that the normal LUT 15*b* has as many reference points as 17**3.

For these reference points, the tone value of each color of CMYKRV is prescribed in terms of values "0-255". Thus, color conversion is accomplished by referencing CMYKRV data which is based on sRGB data. Except for reference points, arbitrary sRGB data is converted into CMYKRV data by interpolation. Needless to say, the normal LUT 15*b* may be selected from different tables for individual media or ink sets which the color printer 40 can use. Incidentally, the above-mentioned image data 15*a* in this embodiment is data in the form of dot matrix representing the tone of each color component of RGB, and it conforms to the sRGB standard. The normal LUT 15*b* may be so constructed as to have the concrete values of sRGB as data; it may also be so constructed as to prescribe the color of a set of specific sRGB data in the predetermined order, with the concrete values of sRGB omitted. Also, the CMYKRV data may be composed of more than 8 bits for better precision or less than 8 bits for memory saving. Likewise, the number of reference points may be other than 17**3.

(3) Procedure for Preparing the Normal LUT

Figure 5:
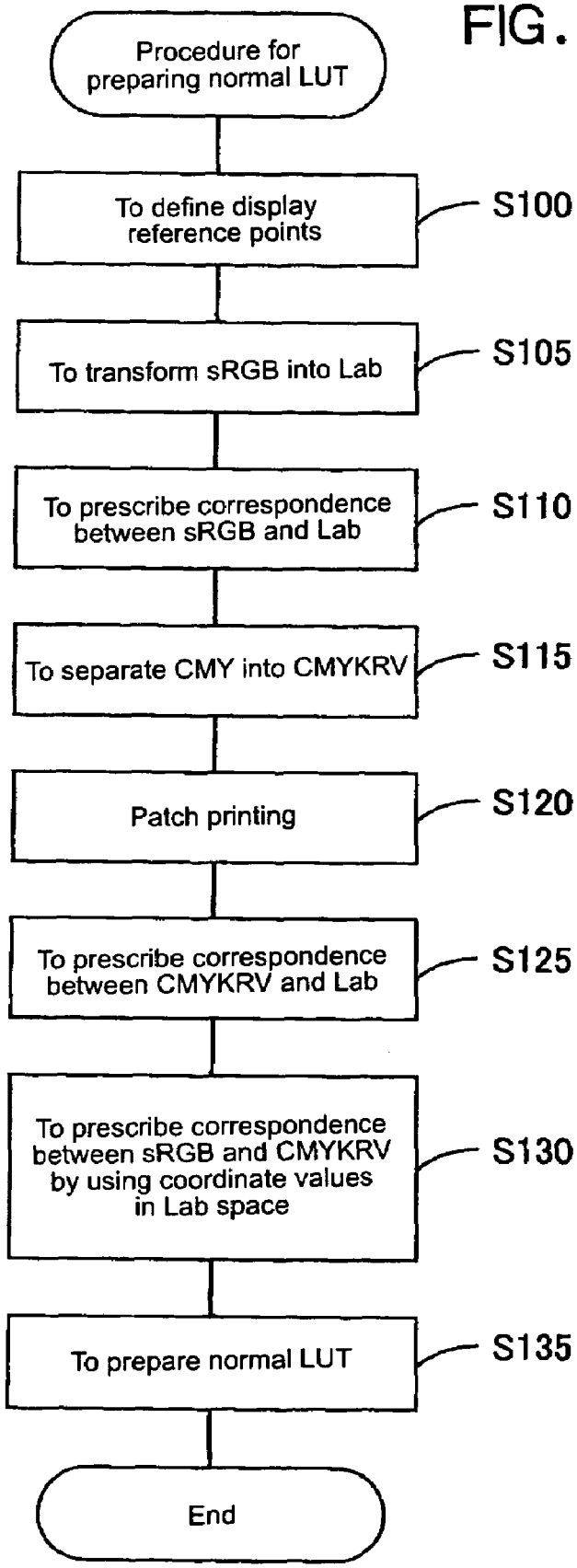
FIG. 5 is a flowchart showing the procedure for preparing the normal LUT.

FIG. 5 is a flowchart showing one example of the procedure for preparing the normal LUT 15*b*. This procedure requires a large amount of arithmetic operation and hence it is desirable to use a computer for arithmetic operation. In this embodiment, the normal LUT 15*b* prepared according to the procedure mentioned in this section is used to prepare the granularity improvement LUT 15*c* according to the procedure mentioned later. In FIG. 5, the normal LUT 15*b* prescribes sRGB data so as to include all the spaces in the sRGB color space. It converts those colors specified by the sRGB data to be used for the display 18 and those colors specified by the CMYKRV data to be used for the color printer 40 into the coordinate values of the Lab space, thereby making the sRGB data correspond to the CMYKRV data in the Lab space. First, the user extracts the reference points of the display 18. Extraction of reference points defines as many sRGB tone values as 173 shown in the left side in FIG. 4 (Step S100**).

Next, the user converts the thus defined sRGB tone values into the coordinate values of the Lab space (Step S105). Any image data conforming to the sRGB standard can be converted into the coordinate values of the Lab space by means of the known converting formula. Therefore, Step S105 may be accomplished in such a way that the sRGB tone values are converted into the coordinate values of the Lab space by means of the known converting formula; alternatively, it may be accomplished in such a way that those colors specified by the reference points are displayed on the display 18 and the coordinate values of the Lab space are obtained by using a colorimeter and the thus measured values are converted. The foregoing step gives the Lab coordinate values of the colors corresponding to the reference points of the sRGB data. The thus obtained Lab coordinate values are used to prescribe the correspondence between the Lab tone values and the 173 sRGB tone values shown in the left side in FIG. 4 (Step S110**).

In this embodiment, CMYK inks are combined with RV inks. Therefore, the CMYKRV data corresponding to sRGB data is prescribed by reducing the values of any of CMY inks or their combination. In other words, the CMY data is separated into CMYKRV data (Step S115). Also, in this embodiment, the amount of CMY inks ejected is allocated to the amount of RV inks ejected as much as possible, and the color with a high lightness is assigned to R ink and the color with a low lightness is assigned to V ink as much as possible. To be more specific, since R has an intermediate hue between Y and M and V has an intermediate hue between C and M in the Lab space, YM is assigned to R as much as possible and then CM is assigned to V as much as possible.

In this embodiment, 1 unit amount of Y ink and 1 unit amount of R ink are allocated to 1 unit amount of R ink, and 0.5 unit amount of C ink and 1 unit amount of M ink are allocated to 1 unit amount of V ink. For example, CMY inks may be allocated to CMYK inks by means of any known method to express a certain color; in this case, if the ratio of the amounts of CMY inks is 0:1:1, then the ratio of the amounts of CMYR inks is prescribed as 0:0:0:1. On the other hand, if the ratio of the amounts of CMY inks is 0.5:1:0, the ratio of the amounts of CMYV inks is prescribed as 0:0:0:1. After Step S115 for allocation, the user prints a number of color patches by using the allocated CMYKRV data (Step S120).

The user records the CMYKRV data used to print the color patches and examines the printed patches for color by means of a colorimeter. The recorded CMYKRV data is made to correspond with the coordinate values of the Lab space (Step S125). The foregoing step gives the Lab coordinate values of the colors corresponding with the respective reference points of the sRGB data and also gives the Lab coordinate values which have been made to correspond with the CMYKRV data. Using these Lab coordinate values, the user prescribes the correspondence between sRGB data and CMYKRV data (Step S130). The above-mentioned procedure completes the normal LUT 15*b* (Step S135). Incidentally, it is not always true that the coordinate values in the Lab space (obtained in Step S120) agree with one another. Correspondence among these data may be obtained by interpolation or optimization. Even interpolation gives an accurate correspondence if a large number of color patches are printed and the Lab coordinate values are obtained for a large number of colors. The normal LUT 15*b* prepared in this manner is stored in the HDD 15.

(4) Procedure for Preparing the Granularity Improvement LUT

Figure 6:
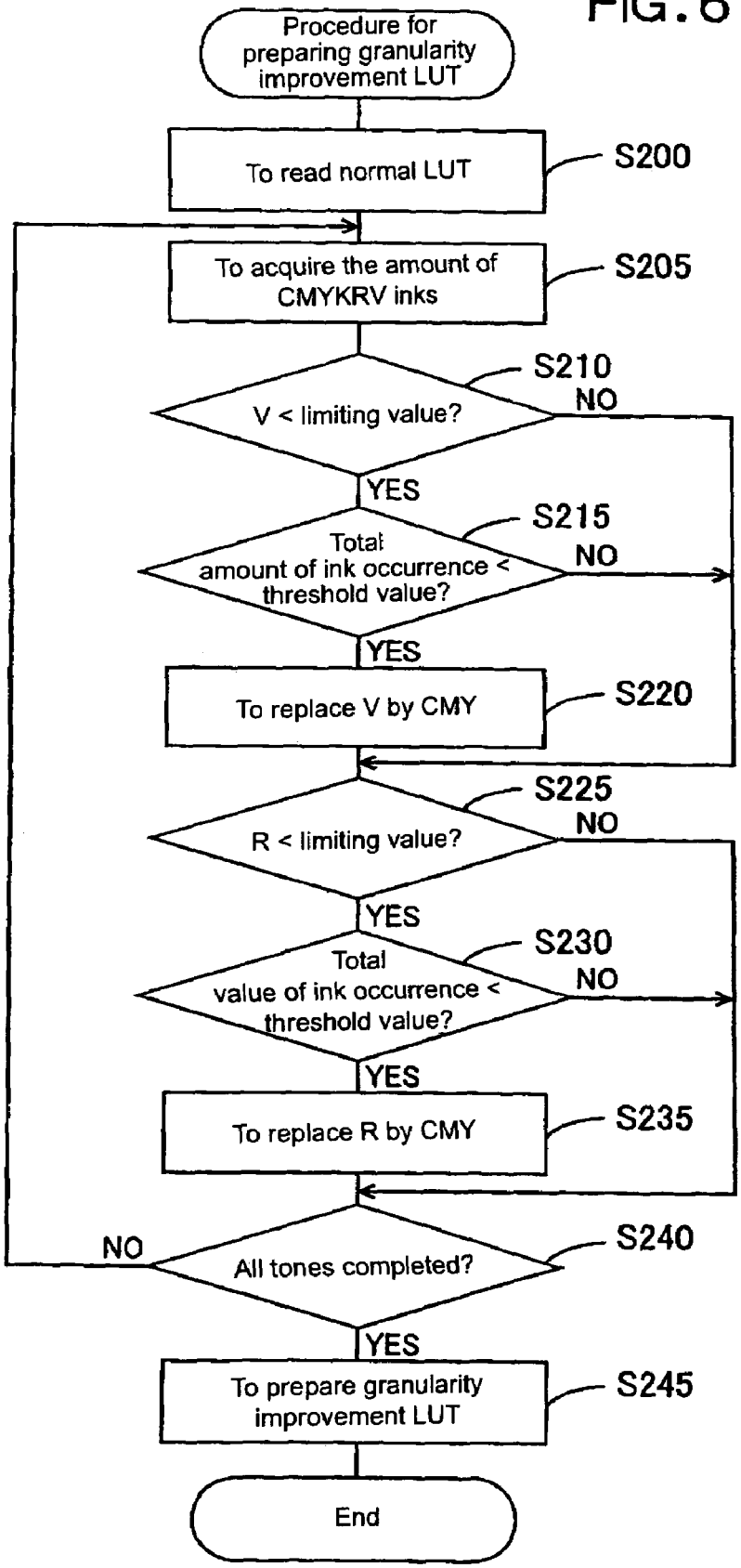
FIG. 6 is a flowchart showing the procedure for preparing the granularity improvement LUT.

FIG. 6 is a flowchart showing the procedure for preparing the granularity improvement LUT 15*c* on the basis of the normal LUT 15*b*. First, the user reads the normal LUT 15*b* which has been prepared according to the foregoing procedure (Step S200). Next, the user acquires the amount of CMYK inks deposited for each tone according to the normal LUT 15*b* (Step S205). Then the user judges whether or not the amount of V ink deposited is smaller than the limiting value (Step S210). If the user judges that the amount of V ink deposited is smaller than the limiting value, the user judges whether or not the total amount of CMY inks deposited is smaller than the threshold value (Step S215). If the user judges that the total amount of CMY inks deposited is smaller than the threshold value, the user replaces the amount of V ink deposited by the amount of CMY inks deposited.

The user performs this replacement according to the above-mentioned ratio (Step S220). The user judges whether or not the amount of R ink deposited is smaller than the limiting value (Step S225). If the user judges that the amount of R ink deposited is smaller than the limiting value, the user judges whether or not the total amount of CMY inks deposited is smaller than the threshold value (Step S230). If the user judges that the total amount of CMY inks deposited is smaller than the threshold value, the user replaces the amount of R ink deposited by the amount of CMY inks deposited. This replacement is accomplished according to the above-mentioned ratio (Step S235). The user carries out steps S205 to S235 for all the tones (Step S240) so as to prepare the granularity improvement LUT 15*c* (Step S245). The thus prepared granularity improvement LUT 15*c* is stored in the HDD 15, so that it can be used for color conversion at the time of printing.

In this embodiment, the normal LUT is prepared first and then the granularity improvement LUT is prepared. However, if the above-mentioned steps S205 to S240 are executed between steps S115 and S120 when the normal LUT is prepared, it is possible to prepare the granularity improvement LUT directly without the procedure to improve the normal LUT.

In this embodiment, since V ink is lower in lightness (or higher in density) than R ink, limitation is imposed preferentially so as to perform replacement by CMY inks first. This makes it possible to improve granularity. Also, in the above-mentioned embodiment, the procedure for preparing the granularity improvement LUT 15*c* is carried out by using only the amount of RV inks deposited. This simplifies the procedure. The thus prepared normal LUT 15*b* and granularity improvement LUT 15*c* are stored in the HDD 15 as mentioned above, so that they can be used for printing.

(5) Content of Printing Procedure

Figure 7:
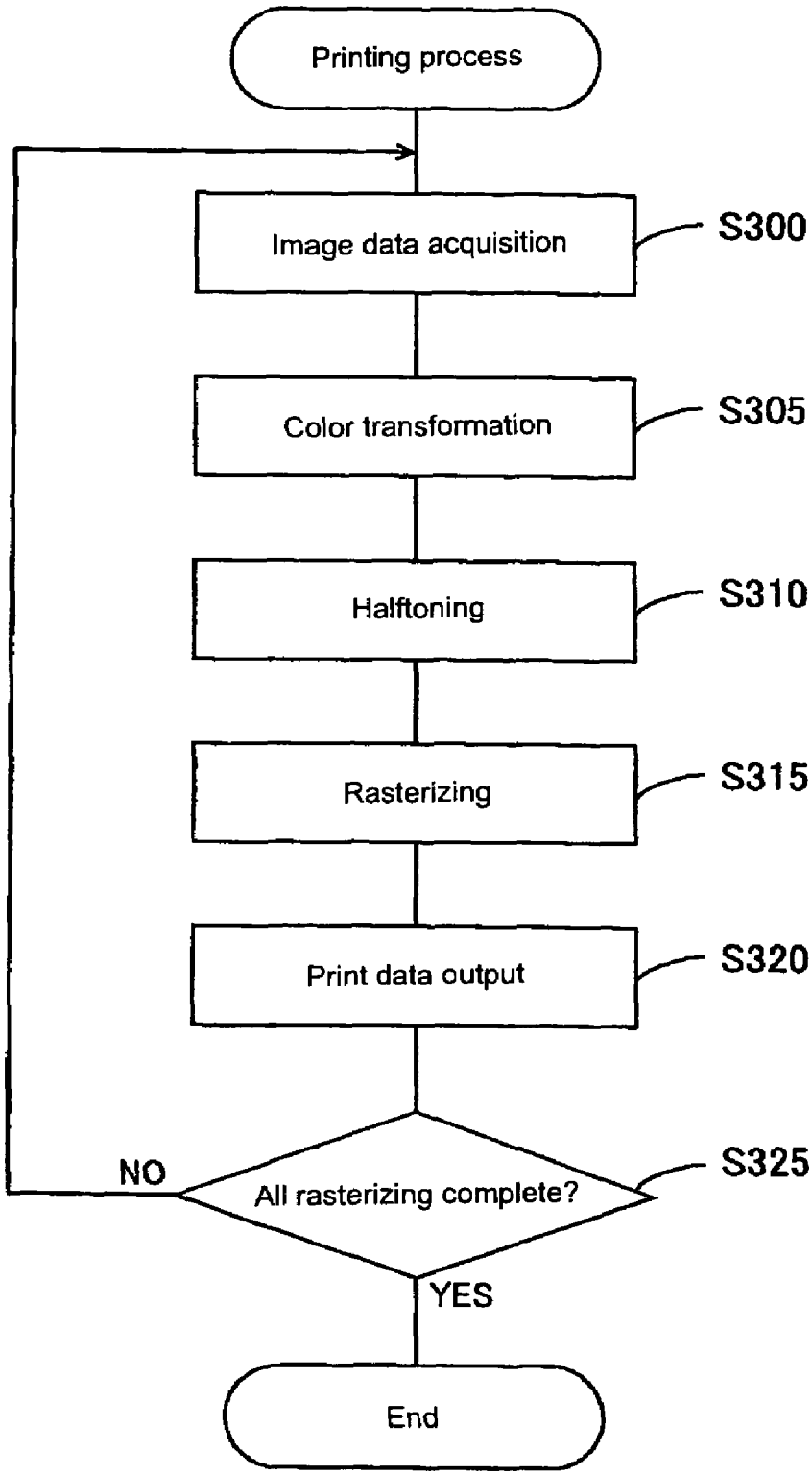
FIG. 7 is a flowchart showing the printing procedure.

In this embodiment, PRTDRV 21 uses the normal LUT 15*b* or granularity improvement LUT 15*c* for color conversion, thereby permitting the color printer 40 to execute printing. For execution of printing, PRTDRV 21 has the image data acquiring module 21*a*, the color conversion module 21*b*, the halftone processing module 21*c*, and the print data generating module 21*d*, as shown in FIG. 3. When the user instructs the execution of printing by APL 25, the printer executes printing according to the flowchart shown in FIG. 7. As soon as printing starts, the image data acquiring module 21*a* acquires the image data 15*a* which has been stored in RAM 14 from the HDD 15 by means of the APPL 25 (Step S300).

Then, the image data acquiring module 21*a* activates the color converting module 21*b*. This color converting module 21*b* converts the RGB tone values into the CMYKRV tone values; it converts each dot data of the image data 15*a* into the dot data of CMYKRV by using the normal LUT 15*b* or the granularity improvement LUT 15*c* (Step S305). As soon as the color converting module 21*b* performs color conversion and generates the tone data of CMYKRV, the half tone processing module 21*c* is activated and the tone data of CMYKRV is transferred to the half tone processing module 21*c*. Here, the half tone processing module 21*c* is intended to perform half tone processing in order to convert the CMYKRV tone value of each dot and express in terms of the recording density of ink drops. It generates the head driving data so that inks deposit according to the recording density after color conversion (Step S310). Then, the print data generating module 21*d* receives the head driving data and rearrange them in the order used by the color printer 40. In other words, the color printer 40 is provided with an ink ejecting device and an ejection nozzle array (not shown). The nozzle array has a plurality of ejection nozzles arranged in the direction of secondary scanning, so that those data several dots apart in the direction of secondary scanning can be used simultaneously.

Then, rasterizing is carried out in order to rearrange sequentially so that those data to be used simultaneously among the data arranged in the direction of primary scanning are buffered simultaneously in the color printer 40 (Step S315). After this rasterizing, it adds specific information (such as image resolution) and generates the print data, and it outputs the print data to the color printer 40 through the parallel communication I/O 19*b* (Step S320). The color printer 40 prints the image displayed on the display 18 according to the print data. The color printer 40 causes individual CMYKRV inks to deposit on the printing medium according to the CMYKRV tone value data mentioned above. The processes in the above-mentioned steps S300 to S320 are executed for all rasters (Step S325).

Figure 8:
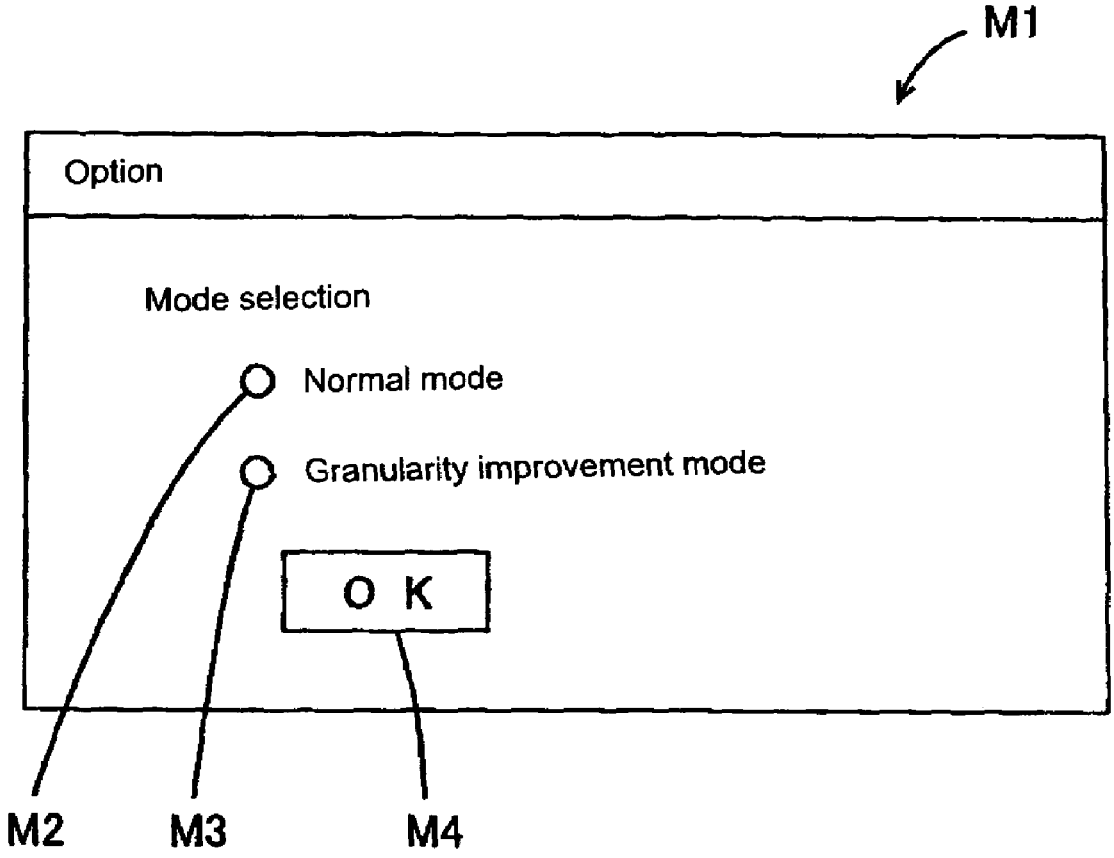
FIG. 8 is a diagram showing the construction of the interface screen.

In this embodiment, when the above-mentioned printing process is executed, the user may select to use the normal LUT 15*b* or the granularity improvement LUT 15*c* for color conversion accomplished by the color converting module 21*b*, by using the interface screen which PRTDRV 21 provides. FIG. 8 is an example of the screen of interface. The user activates the PRTDRV 21 so as to display the interface screen M1 on the display 18. Then, the user selects the mode by using an input device such as mouse 32. This mode selection is accomplished by selecting the switch M2 for "normal mode" to use the normal LUT 15*b* for color conversion, or by selecting the switch M3 for "granularity improvement mode" to use the granularity improvement LUT 15*c* for color conversion. The user selects either mode by selecting the switch M2 or M3, and then the user presses the OK button M4 to terminate the mode selection. This mode selection is reflected in the color converting processing that is carried out in Step S305 for printing process mentioned above.

Figure 9:
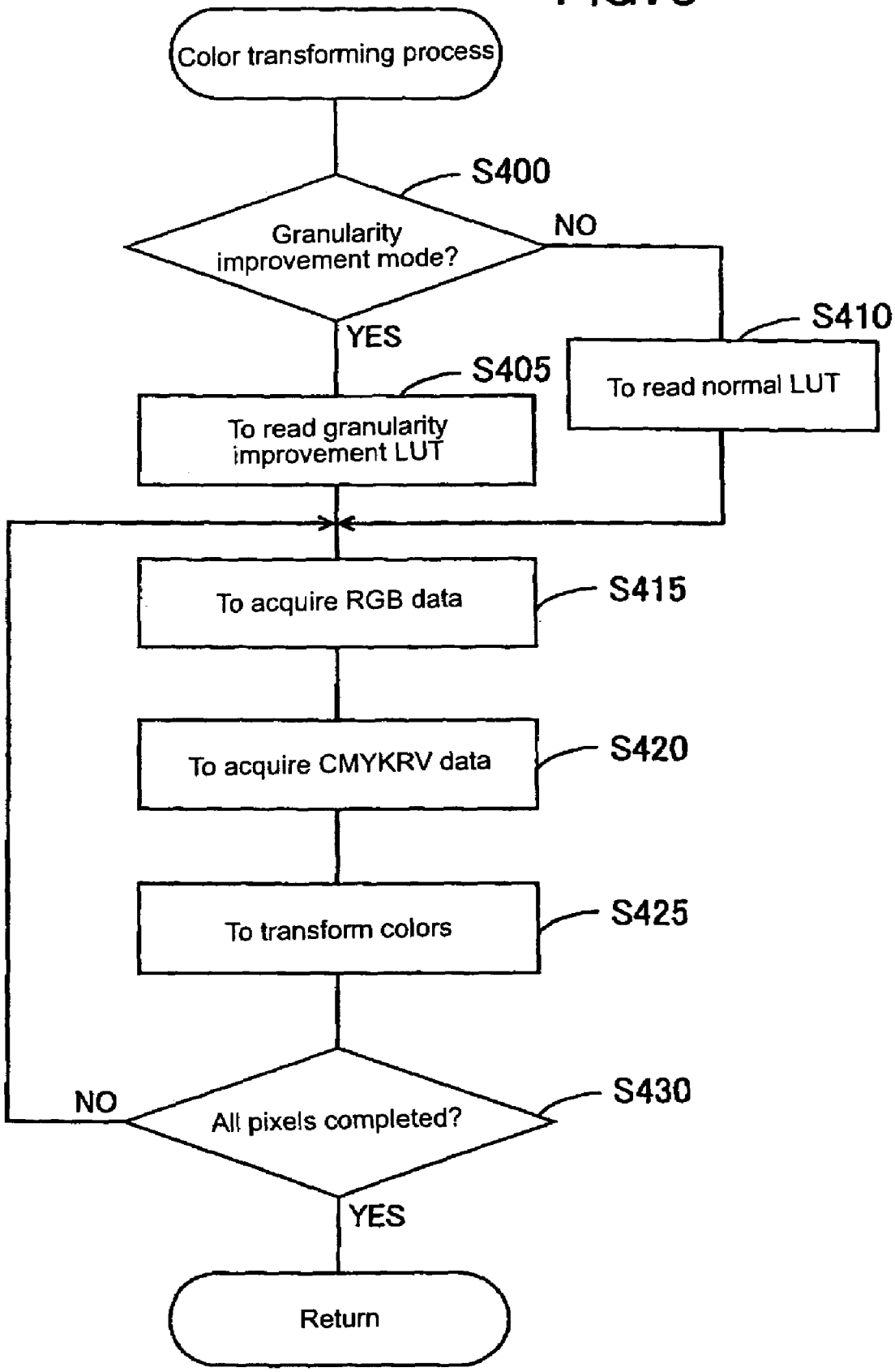
FIG. 9 is a flowchart for the procedure of color conversion.

FIG. 9 is a flowchart showing the color converting process in this embodiment, with the mode selection being made by the above-mentioned method. In this flowchart, the PRTDRV acquires the content of setting of the interface screen M1 and judges whether or not it is the granularity improvement mode (Step S400). If the PRTDRV judges that the content of setting is the granularity improvement mode, it reads the granularity improvement LUT 15*c* from the HDD 15 (Step S405). On the other hand, if the PRTDRV judges that the content of setting is the normal mode, it reads the normal LUT 15*b* from the HDD 15 (Step S410). The PRTDRV acquires sRGB data for each pixel of the image data 15*a* (Step S415). The PRTDRV acquires the CMYKRV data corresponding to the sRGB data according to the granularity improvement LUT 15*c* or the normal LUT 15*b* which has been read in Step S405 or Step S410 (Step S420). The PRTDRV executes color conversion from sRGB data into CMYKRV data (Step S425). The PRTDRV repeats the above-mentioned steps S415 to S425 for all the pixels (Step S430).

The flowchart in FIG. 9 provides a chance to select one of the LUTs. But, to improve the quality of printed output, the flowchart may be changed not to provide a chance to select the LUTs. Namely only the granularity improvement LUT 15*c* may be used in the printing process.

Figure 10:
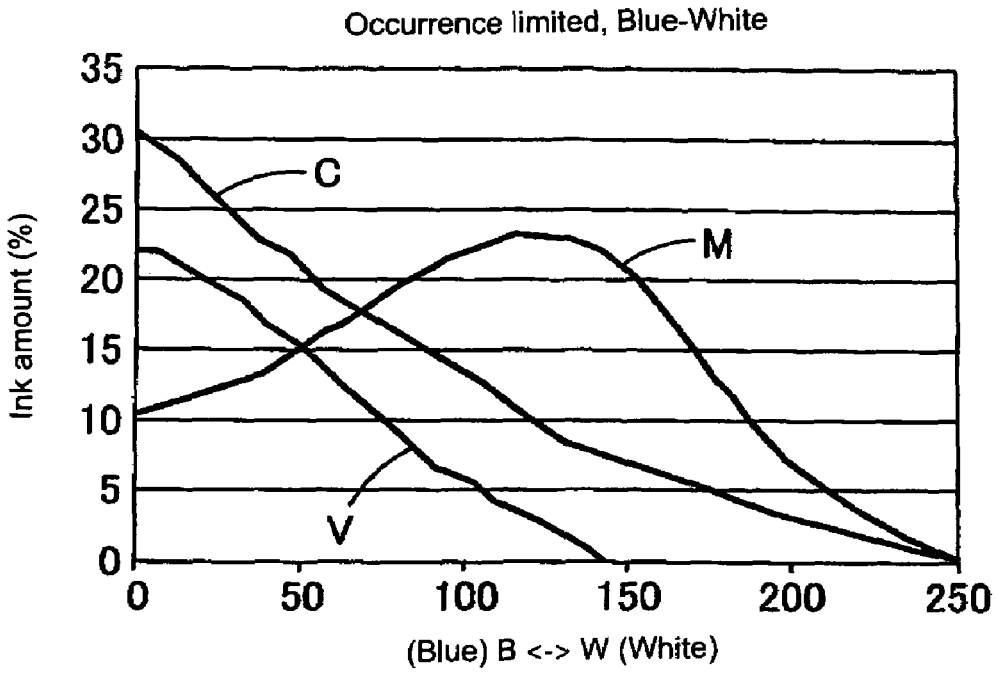
FIG. 10 is a diagram showing an embodiment in which the amount of V ink is limited.
Figure 10:
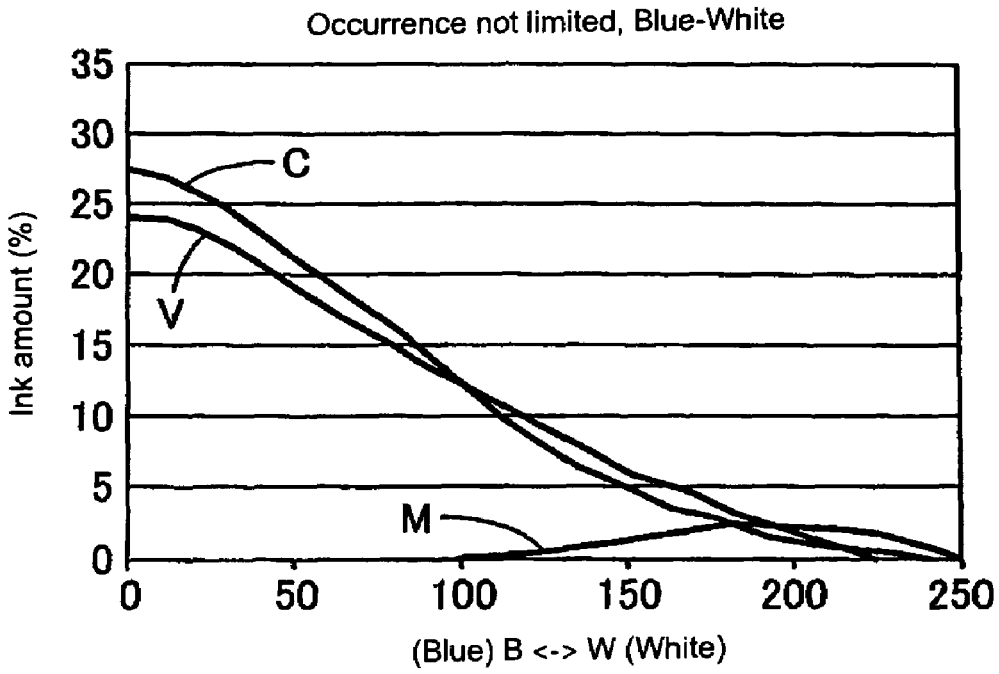
Figure 11:
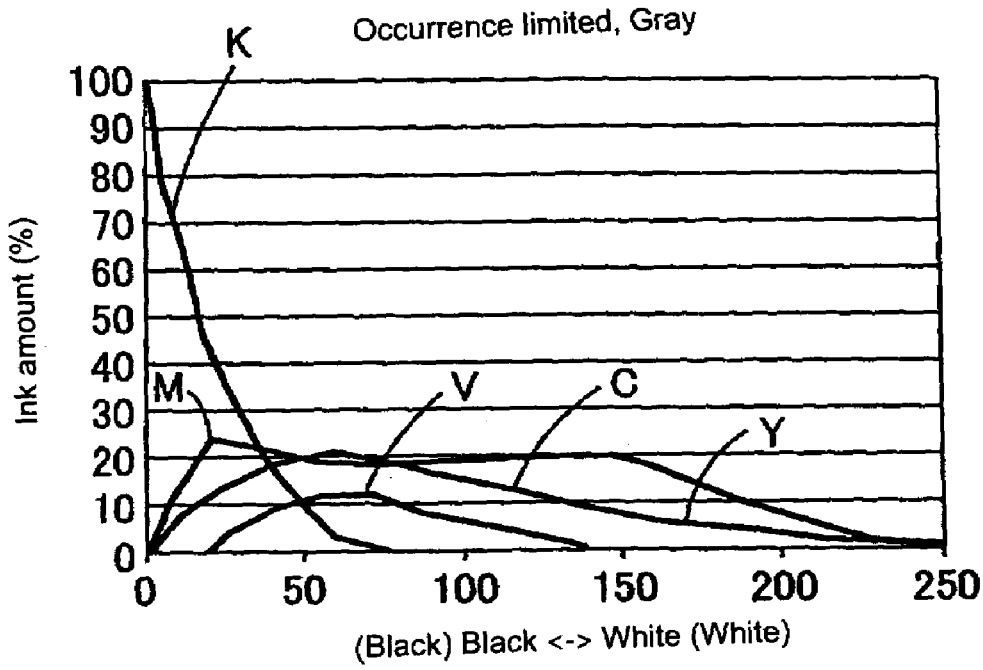
FIG. 11 is a diagram showing an embodiment in which the amount of V ink is limited.
Figure 11:
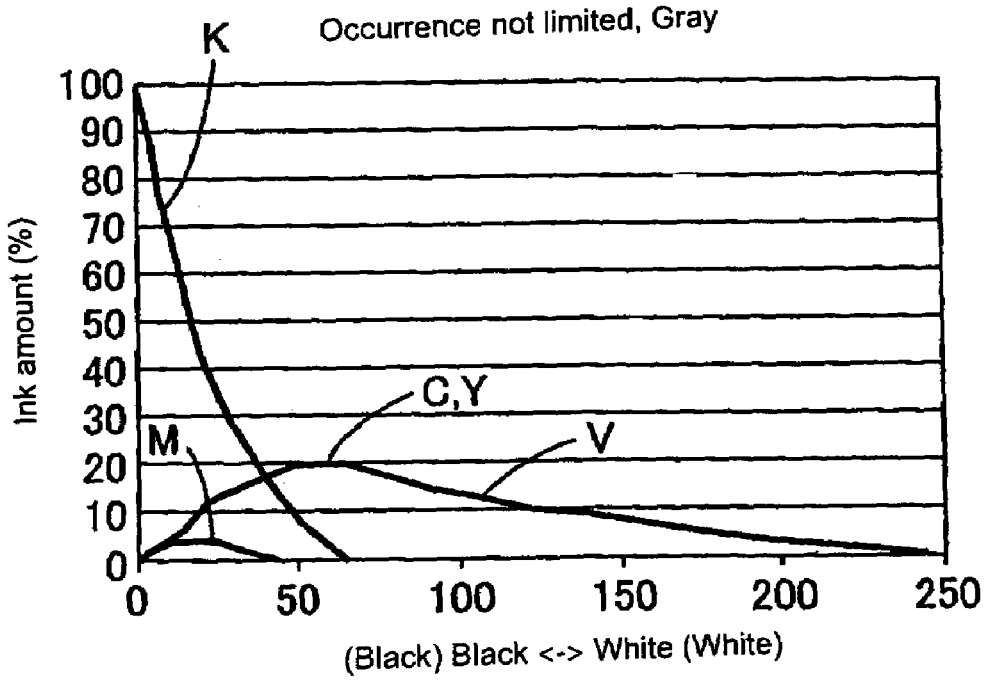

FIGS. 10 and 11 show an example in which the deposition of RV inks is limited by the granularity improvement LUT 15*c*. These figures illustrate the limiting of deposition of V ink. FIG. 10 shows the amount (%) of CMYV inks in the Blue-white axis ((R,G,B=0, 0, 255) (R,G,B=255, 255, 255)). The upper figure shows the case in which deposition is limited, and the lower figure shows the case in which deposition is not limited. FIG. 10 indicates that the deposition of V ink is limited before 150 tones. In other words, it is possible to improve granularity because V ink does not deposit beyond that tone. By contrast, FIG. 11 shows the amount (%) of CMYV inks in the Gray axis ((R,G,B=0, 0, 0) (R,G,B=255, 255, 255)). The upper figure shows the case in which deposition is limited, and the lower figure shows the case in which deposition is not limited. FIG. 11 indicates that the deposition of V ink is limited before 150 tones. In other words, it is possible to improve granularity because V ink does not deposit beyond that tone.

(6) Other Procedures for Preparing the Granularity Improvement LUT

The granularity improvement LUT 15*c* prepared by the above-mentioned procedure limits the amount of RV inks deposited if it is smaller than the prescribed limiting value; therefore, the LUT 115*c* limits ink deposition even in the region of low lightness where RV inks do not inherently influence the granularity. So, the LUT 15*c* limits the deposition of RV inks only in the case where the total amount of all CMYRV inks deposited is smaller than the limiting value. In this way it is possible to prevent the LUT 15*c* from limiting the deposition of RV inks in the case where the amount of the entire ink deposition is large (in the case of the region of low lightness) even though the amount of deposition of RV inks (which is the object to be limited) is small. It is also possible to perform the limiting that depends on the amount of deposition of other inks than RV inks.

Figure 12:
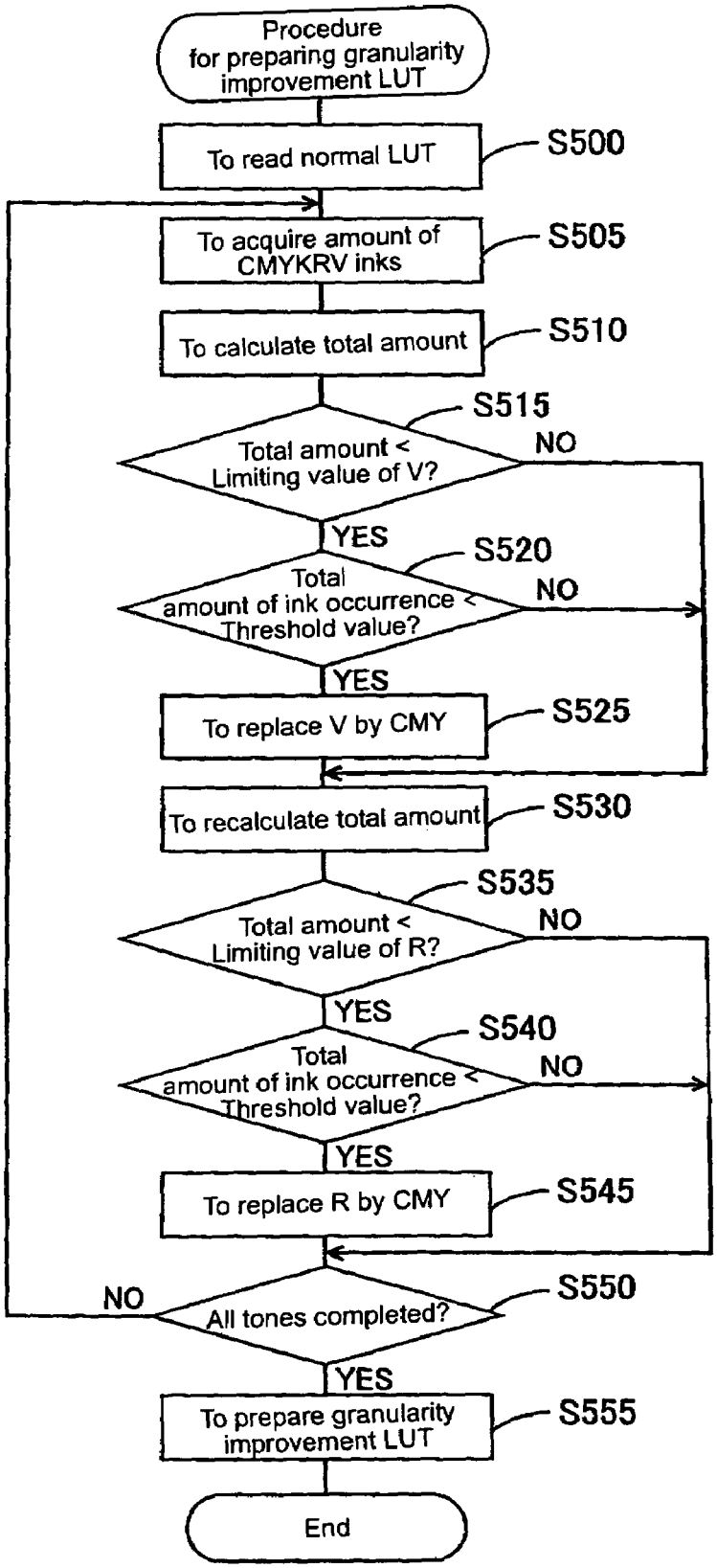
FIG. 12 is a flowchart for the procedure for preparing the granularity improvement LUT.

FIG. 12 is a flowchart showing the procedure to realize the granularity improvement LUT 15*c*. The user reads the normal LUT 15*b* prepared first (Step S500). Then, the user acquires the amount of CMYK inks deposited for each tone according to the normal LUT 15*b* (Step S505) and calculates the total amount of each ink (Step S510) from the following formula (1).

$$\text{Total amount}=0.8C+0.7M+0.6Y+0.9R+V+1.5K \quad (1)$$

After calculation of the total amount, the user judges whether or not the total amount is smaller than the prescribed limiting value (Step S515). If the user judges that the total amount is smaller than the prescribed limiting value of V ink, the user judges whether or not the amount of deposition of all inks is smaller than the prescribed threshold value (Step 5520). Then, if the user judges that the amount of deposition of all inks is smaller than the prescribed value, the user replaces V ink by CMY inks according to the above-mentioned ratio (Step S525).

If the user has replaced V ink by CMY inks in this step S525 or the user has judged in Step S515 that the total amount is larger than the limiting value for V ink or the user has judged in Step 520 that the amount of deposition of all inks is larger than the prescribed threshold value, then the user calculates again the total amount (Step S530). This total amount, which is for judging R ink, is calculated from the formula (2) below.

$$\text{Total amount}=0.9C+0.9M+0.6Y+R+1.2V+1.7K \quad (2)$$

After calculation of the total amount, the user judges whether or not the total amount is smaller than the prescribed limiting value (Step S535). If the user judges that the total amount is smaller than the prescribed limiting value of R ink, the user judges whether or not the amount of all inks deposited is smaller than the prescribed threshold value (Step S540). Then, if the user judges that the amount of all inks deposited is smaller than the prescribed value, the user replaces R ink by CMY inks according to the above-mentioned ratio (Step S545). The user executes the above-mentioned steps S505 to S545 for all tones (Step S550) and prepares the granularity improvement LUT 15*c* (Step S555).

Figure 13:
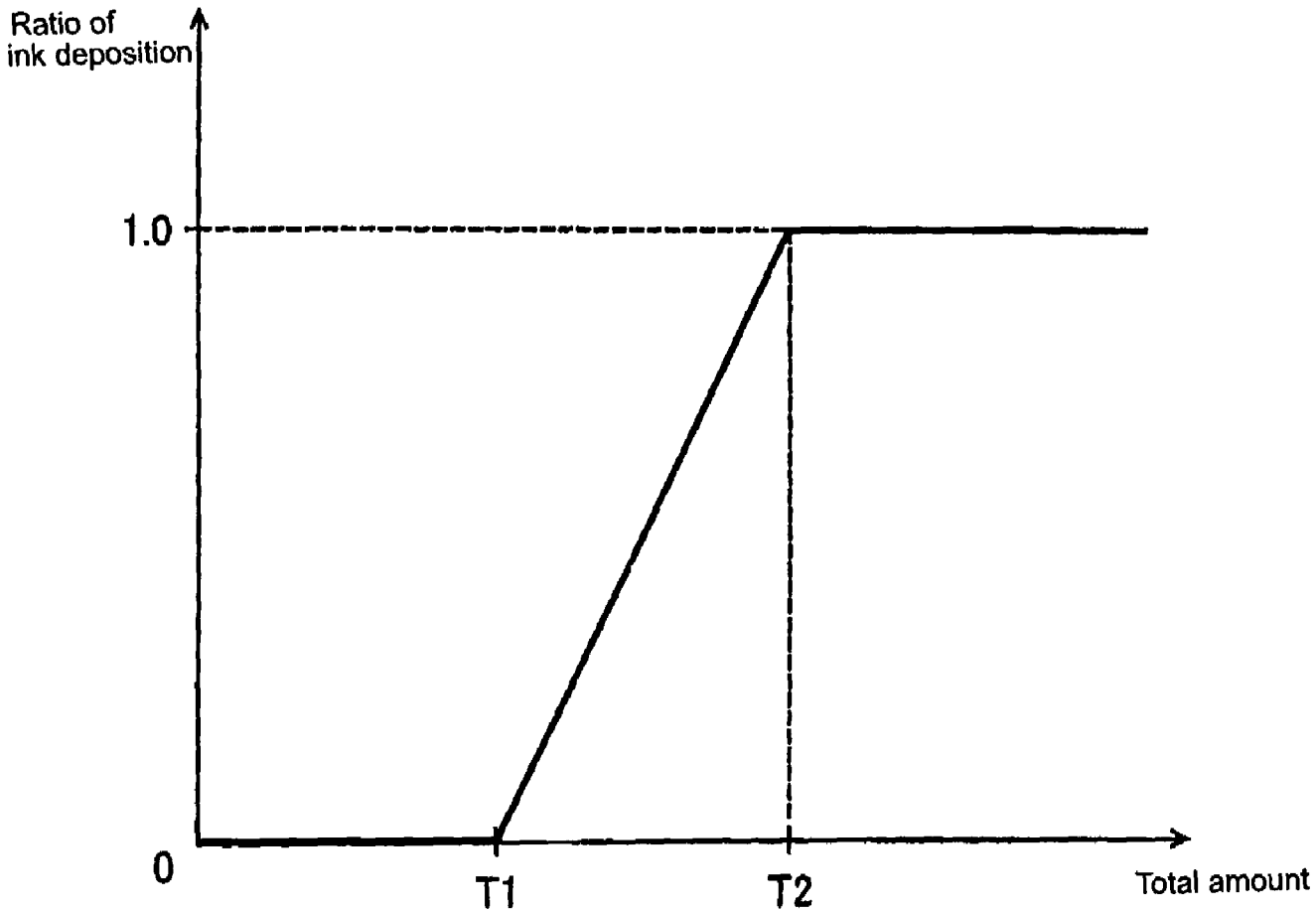
FIG. 13 is a diagram showing the method of prescribing the ratio of ink deposition.
Figure 14:
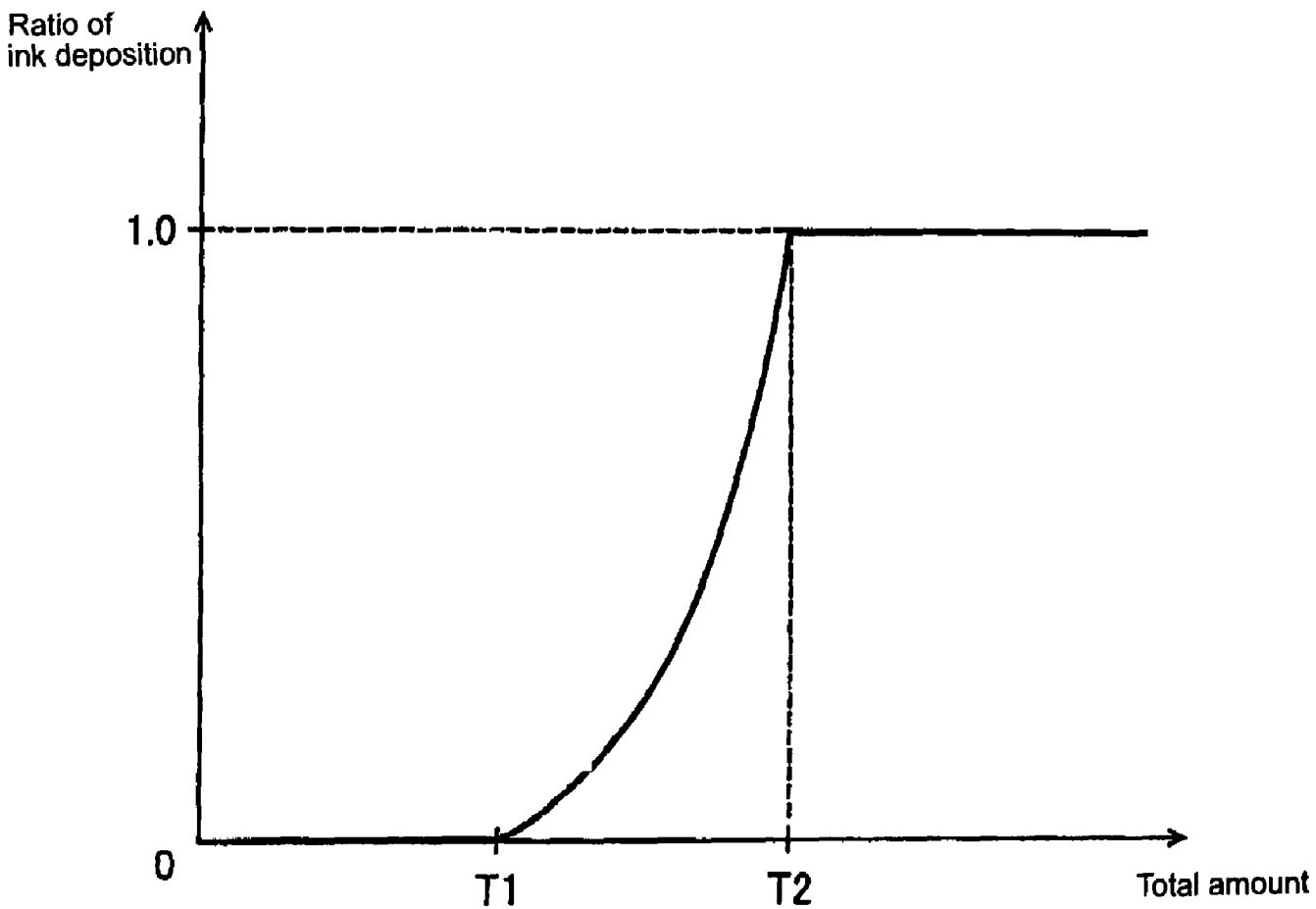
FIG. 14 is a diagram showing the method for prescribing the ratio of ink deposition.

FIG. 13 illustrates the concept of the limiting ratio used to limit the amount of deposition of V ink or R ink in this embodiment. In this figure, T1 represents the total amount at which the deposition of V ink or R ink starts. Therefore, if the total amount is more than 0 and less than T1, the deposition of V ink or R ink is limited. In other words, the amount of deposition of V ink or R ink becomes 0. By contrast, if the total amount is more than T2, the total amount is excessive and it is the region in which the deposition of V ink or R ink is not limited. In other words, the data of the normal LUT 15*b* is used as such for V ink or R ink. On the other hand, if the total amount is more than T1 and smaller than T2, it is replaced by the amount of deposition of V ink or R ink according to the shown slope, and it is replaced by CMY ink according to the replaced amount of deposition of ink. In FIG. 14, the ratio of deposition changes linearly; however, the manner of change may be non-linear (curve) as shown in FIG. 14. This is simply one example, and it is possible to adopt the γ-curve.

(7) Other Procedures for Preparing the Granularity Improvement LUT

The above-mentioned embodiment is intended to prepare the granularity improvement LUT 15*c* which permits improvement in ink granularity in the region of high lightness. This object is achieved by limiting the deposition of RV inks according to the amount of deposition of RV inks (as the object to be limited), the amount of deposition of all inks, or the total amount of inks. From the standpoint of improving granularity in the region of high lightness, the granularity improvement LUT 15*c* may be prepared such that the deposition of RV inks is limited in the region where lightness is higher than a prescribed value.

Figure 15:
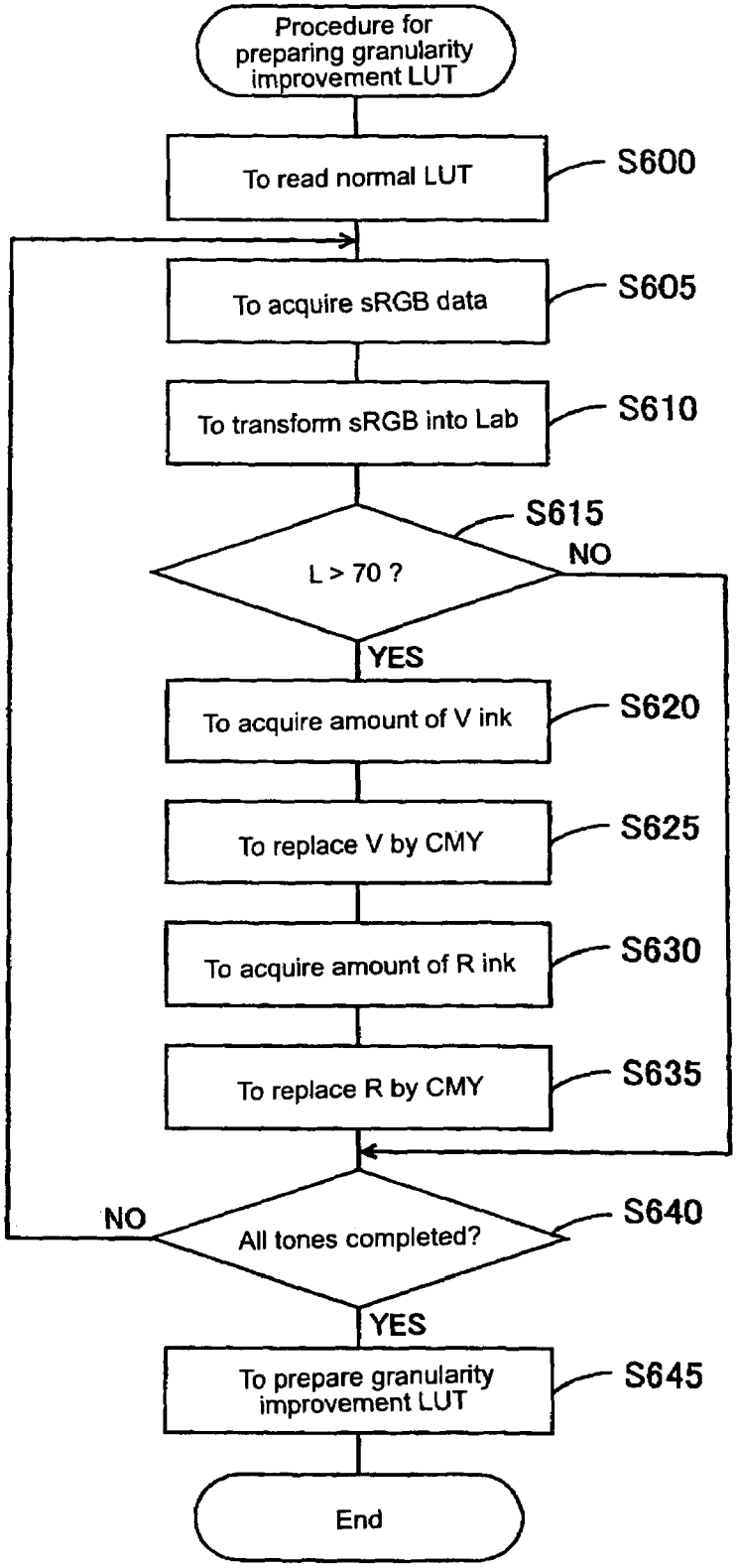
FIG. 15 is a flowchart showing the procedure for preparing the granularity improvement LUT.

FIG. 15 is a flowchart showing the procedure for preparing the granularity improvement LUT 15*c* for such a purpose. First, the user reads the normal LUT 15*b* previously prepared (Step S600). Then, the user acquires sRGB data in the normal LUT 15*b* which has been read (Step S605). The user converts sRGB data into the coordinate values of Lab space (Step S610). Then, the user judges whether or not the L coordinate of the converted coordinate value is larger than 70 (Step S615). If the coordinate value is larger than 70, the user acquires the amount of V ink (Step S620), replaces it by CMY ink according to the above-mentioned ratio (Step S625), acquires the amount of R ink (Step S630), and replaces it by CMY inks according to the above-mentioned ratio (Step S635). The user executes the above-mentioned steps S605 to S630 for all tones (Step S640). Finally, the user prepares the granularity improvement LUT 15*c* according to the replaced data (Step S645).

The above-mentioned embodiment is carried out in such a way that the granularity improvement LUT 15*c* is prepared according to the predetermined procedure and then stored in the HDD 15, and the user selects either the normal LUT 15*b* or the granularity improvement LUT 15*c* at the time of printing. The method for preparing and storing the LUT is not restricted. Needless to say, it is possible to prepare the granularity improvement LUT 15*c* from the normal LUT 15*b* according to selection.

(8) Summary

Color conversion with the help of the granularity improvement LUT 15*c* that limits the deposition of RV inks makes it possible to limit the ejection of RV inks in the region of high lightness and hence makes it possible to improve the ink granularity in the region of high lightness.

What is claimed is:

1. A printer ejecting control method for controlling a printer to eject at least three chromatic color inks and additional chromatic color inks having a lower lightness than said at least three chromatic color inks from a print head at the time of printing, which comprises a step of determining an amount of said at least three chromatic color inks and said additional chromatic color inks being ejected from said print head, a step of detecting a limiting condition to limit the above determined amount of the additional chromatic color inks being ejected by detecting a lightness of an area where the additional chromatic color inks are being ejected, said step of detecting said limiting condition detecting said limiting condition when the above determined amount of the additional chromatic color inks ejected is lower than a prescribed first threshold value, and a step of replacing the above determined amount of the additional chromatic color inks being ejected by the amount of said at least three chromatic color inks being ejected when said limiting condition is detected.

2. The printer ejecting control method as defined in claim 1, in which said step of detecting the limiting condition calculates the total amount of ink ejection, which is the sum of the amount of at least three chromatic color inks ejected and the amount of the additional chromatic color inks ejected, and detects said limiting condition when the amount of the additional chromatic color inks ejected is lower than said first threshold value and the total amount of all inks ejected is lower than a prescribed second threshold value.

3. The printer ejecting control method as defined in claim 1, in which said step of detecting the limiting condition calculates the total amount of ink deposition, which is the sum of the amount of at least three chromatic color inks deposited and the amount of the additional chromatic color inks deposited, and detects said limiting condition when the calculated total amount of inks ejected is lower than said first threshold value.

4. The printer ejecting control method as defined in claim 3, in which said step of detecting the limiting condition detects said limiting condition when the calculated total amount of inks ejected is lower than a prescribed third threshold value.

5. The printer ejecting control method as defined in claim 2, in which said step of calculating the total ink amount calculates the total amount of inks ejected by weighting parameters for each of said at least three chromatic color inks and said additional chromatic color inks when calculating the total amount of inks ejected.

6. The printer ejecting control method as defined in claim 1, in which said step of detecting the limiting condition detects calculates the lightness which is expressed according to the amount of said at least three chromatic color inks ejected and said additional chromatic color inks ejected, and detects the limiting condition when the calculated lightness is higher than the prescribed lightness.

7. The printer ejecting control method as defined in any of claims 1 and 2 to 6, in which said additional chromatic color inks include a plurality of chromatic color inks differing in lightness, and said step of replacing inks to be ejected sequentially replaces said chromatic color inks having a lower lightness by said at least three chromatic color inks.

8. A printer ejecting control apparatus for controlling a printer to eject at least three chromatic color inks and additional chromatic color inks having a lower lightness than said at least three chromatic color inks from a print head at the time of printing, which comprises a unit for determining an amount of said at least three chromatic color inks being ejected from said print head and an amount of said additional chromatic color inks being ejected from said print head, a unit for detecting a limiting condition to limit the above determined amount of the additional chromatic color inks being ejected by detecting a lightness of an area where the additional chromatic color inks are being ejected, said unit for detecting said limiting condition detecting said limiting condition when the above determined amount of the additional chromatic color inks ejected is lower than a prescribed first threshold value, and a unit for replacing the above determined amount of the additional chromatic color inks being detected by the amount of said at least three chromatic color inks being ejected when said limiting condition is detected.

9. A computer-readable storage medium encoded with a program which permits a computer to achieve a function of controlling a printer to eject at least three chromatic color inks and additional chromatic color inks having a lower lightness than said at least three chromatic color inks from a print head at the time of printing, which comprises a function for determining an amount of said at least three chromatic color inks being ejected from said print head and an amount of said additional chromatic color inks being ejected from said print head, a function for detecting a limiting condition to limit the above determined amount of the additional chromatic color inks being ejected by detecting a lightness of an area where the additional chromatic color inks are being ejected, said function for detecting said limiting condition detecting said limiting condition when the above determined amount of the additional chromatic color inks ejected is lower than a prescribed first threshold value, and a function for replacing the above determined amount of the additional chromatic inks being ejected by the amount of said at least three chromatic color inks being ejected when said limiting condition is detected.

* * * * *